US006625937B1

(12) United States Patent
Parker et al.

(10) Patent No.: US 6,625,937 B1
(45) Date of Patent: Sep. 30, 2003

(54) MODULAR BUILDING AND METHOD OF CONSTRUCTION

(75) Inventors: Robert Parker, Houston, TX (US); Cecil Wondrash, East Bernard, TX (US); Matt Tindol, Berkeley, CA (US); Barham Moss, Arlington Heights, IL (US); Chris Church, Spring, TX (US); Doug Brown, Houston, TX (US); Kyle Brock, Houston, TX (US); Don Gehring, Conroe, TX (US); Sudhir Gholkar, Houston, TX (US)

(73) Assignee: Sunrise Holding, Ltd., Houston, TX (US)

( * ) Notice: Subject to any disclaimer, the term of this patent is extended or adjusted under 35 U.S.C. 154(b) by 0 days.

(21) Appl. No.: 09/749,275

(22) Filed: Dec. 27, 2000

(Under 37 CFR 1.47)

(51) Int. Cl.[7] ..... E04B 1/00
(52) U.S. Cl. ..... 52/79.7; 52/79.1; 52/79.9; 52/79.12
(58) Field of Search ..... 52/79.1, 79.7, 52/79.9, 79.2, 79.12

(56) References Cited

U.S. PATENT DOCUMENTS

| | | | | | |
|---|---|---|---|---|---|
| 3,564,786 | A | | 2/1971 | Baker | 52/79 |
| 3,710,521 | A | | 1/1973 | Danin | 52/27 |
| 3,754,364 | A | | 8/1973 | Ice | 52/187 |
| 3,792,558 | A | * | 2/1974 | Berce et al. | 206/321 |
| 3,822,519 | A | * | 7/1974 | Antoniou | 52/79.13 |
| 3,824,750 | A | * | 7/1974 | Antoniou | 52/223.4 |
| 3,835,601 | A | | 9/1974 | Kelbish | 52/79 |
| 3,852,924 | A | | 12/1974 | Levenson | 52/79 |
| 3,881,283 | A | | 5/1975 | Pender | 52/79 |
| 3,900,994 | A | | 8/1975 | Van Der Lely | 52/236 |
| 3,940,890 | A | | 3/1976 | Postlethwaite | 52/79 |
| 3,982,732 | A | * | 9/1976 | Pender | 212/195 |
| 4,098,039 | A | | 7/1978 | Sutelan | 52/73 |
| 4,221,441 | A | | 9/1980 | Bain | 312/228 |
| 4,398,378 | A | | 8/1983 | Heitzman | 52/251 |
| 4,447,996 | A | | 5/1984 | Maurer, Jr. et al. | 52/79.1 |
| 4,545,158 | A | * | 10/1985 | Rizk | 52/238.1 |
| 4,807,407 | A | * | 2/1989 | Horn | 52/125.2 |
| 5,435,476 | A | | 7/1995 | Simpson | 227/2 |
| 5,643,488 | A | | 7/1997 | Lee | 249/34 |
| 5,782,047 | A | | 7/1998 | De Quesada | 52/236.6 |
| 5,867,964 | A | * | 2/1999 | Perrin | 52/236.8 |

* cited by examiner

*Primary Examiner*—Carl D. Friedman
*Assistant Examiner*—Basil Katcheves
(74) *Attorney, Agent, or Firm*—Vinson & Elkins, LLP

(57) ABSTRACT

A method of constructing low cost housing is disclosed in which modules are produced in a manufacturing facility and are transported to a building site on trailers and lifted into place with a crane. A few standard modules are produced and may be arranged in various configurations to produce a variety of floor plans.

18 Claims, 13 Drawing Sheets

MODULAR BUILDING AND METHOD OF CONSTRUCTION

SUMMARY

The invention relates to modular building construction and to buildings in which a plurality of standard prefabricated modules may be arranged in alternate arrangements to construct desirable multifamily housing at high volume and low cost. In a specific preferred embodiment of the invention, five types of modules are constructed so that three of the five may be utilized to produce a one bedroom apartment and that four of the five may be utilized to produce a two bedroom apartment. Alternate modules or other combinations of modules may also be used to construct 3 or more bedroom houses or apartments utilizing the principles demonstrated by the one and two bedroom apartments described as preferred embodiments herein. The modules may be used to construct single family residences or more preferably to construct multifamily or even multistory buildings. For example, the invention described herein may be applied with great advantage to the construction of a subdivision or neighborhood of single family residences, or for various types of group residences such as nursing homes, geriatric housing, military housing, housing for athletes in an event or training facility, or any type of dormitory related to an educational or commercial institution. The methods and buildings described herein are particularly useful as housing units for urban, low cost multifamily housing and/or student housing near colleges or universities, or in any setting where a large number of units may be constructed near a manufacturing facility. Although the preferred embodiments described herein are residential buildings, the invention may also encompass commercial buildings that include offices, studios, retail spaces or any combination thereof.

In a preferred embodiment, a multifamily residential building includes two building segments in a face to face orientation. Each segment includes a ground floor or first floor comprising a row of apartments disposed with common side walls separating each apartment from its immediate neighbor. The apartments may be any combination of one, two and three bedroom apartments, and a preferred arrangement is a row of alternating one and two bedroom apartments, preferably with 2 of each per floor for a total of 4 apartments per floor. The apartment modules may also be stacked vertically to achieve a multistory building of 2, 3, 4 or even 5 floors in a residential building. For use as a low cost, high volume production multifamily housing project, the preferred arrangement is a 3 story building with 12 apartments per building segment. In a multistory building, like modules are preferably stacked on top of like modules in order to facilitate vertical utility and electrical connections between floors. For example, a single utility chase may be incorporated into the same type of modular unit in each apartment and these chases would then be aligned vertically in the multistory building for ease of making vertical connections between floors. For multifamily housing developments, the buildings may be arranged or spaced in any manner to facilitate construction and to conform to the terrain of the building site. In certain building projects, two building segments are spaced apart by only a few feet so that the buildings may share common stairways, breezeways, sidewalks, or other exterior features, although various other arrangements are possible. For example, a stairway may serve one apartment per floor in which the apartment entrances are substantially vertically aligned, or common breezeways may be constructed in the front or rear of the buildings or both, or stairways may be constructed in any combination. In a preferred site development, pairs of building segments are spaced in opposing fashion to form a building and share a common breezeway on each floor and a stair tower at each end of the buildings serving each floor.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein. It is understood that the drawings are not necessarily to scale, but are representations of the embodiments shown.

DETAILED DESCRIPTION

A preferred embodiment of the present invention is a building composed of modules that are constructed in a manufacturing facility, transported to a building site, and are permanently installed at the building site as adjoining components of a building. A preferred type of building is a multifamily residential building that can be constructed in high volume at low cost. Constructing modules in a manufacturing facility saves labor and material costs because the materials can be standardized and much of the waste eliminated. In addition, most of the process can be automated or performed by semi-skilled workers. The modules may be constructed to a semi-finished state in the manufacturing facility including the framing of floors, all walls and ceilings, installation of doors, windows, electrical wiring, plumbing, wall insulation, ground floor insulation and vapor barrier, and ducting for heating and air conditioning. The semi-finished state may also include exterior sheathing, base cabinets and plumbing fixtures such as bathtubs, sinks or showers. In a preferred embodiment, the modules are transported to a building site individually on trailers and installed with a crane at the building site.

An aspect of the present disclosure is a residential building that is composed of modules and that provides a pleasant and functional living unit or apartment at a cost that is lower than would be possible for an apartment that was built on site with conventional site built construction methods common to the multi-family construction industry. It is also understood that the building may be easily "up-graded" by the addition of a higher grade cabinets, floor covering, appliances, fixtures and other amenities to provide well-constructed more expensive, or even luxury apartments at a lower cost than is possible with conventional site built construction.

Figure 1:
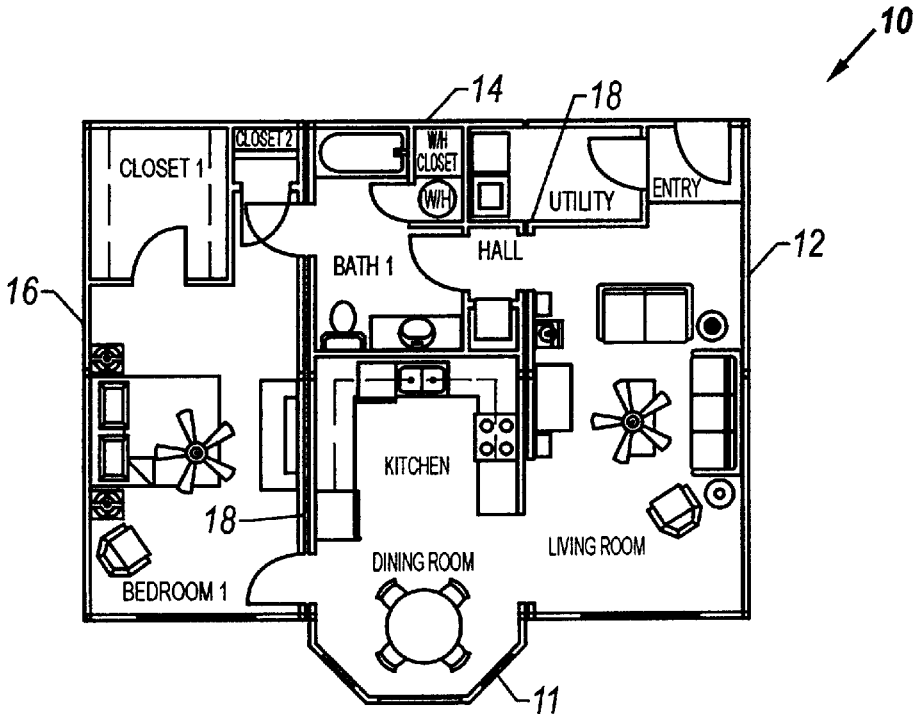
FIG. 1 is a floor plan view of a one bedroom unit constructed from 3 modules.

The preferred embodiment includes one bedroom and two bedroom apartment units that are constructed using 5 types of modules. A preferred floor plan design for a one bedroom apartment is shown in FIG. 1. The one bedroom unit, or apartment 10, is constructed of 3 modules, a first module 12 providing an entry, living room, and partial laundry room; a second module 14 adjoining the first module and providing a kitchen, dining area, bathroom and the remainder of the laundry room; and a third module 16 adjoining the second module 14 on the opposite side wall from said first module 12 and providing a bedroom and closets. The second module, 14 also provides a closet for the heating/air handler and a utility chase for the water heater and all vertical plumbing and electrical connections in a multistory building. The second module in this embodiment also provides a bay window 11 in the rear wall thereof that is shown in this drawing to contain a dining room. As used herein, the term bay window has its ordinary meaning and is a window space that projects outward from the wall of a building. A bay window may be rectangular, square or polygonal as shown in FIG. 1. As can be seen in FIG. 1, the interior side walls of the modules are abutted to provide double thick walls 18.

Figure 2:
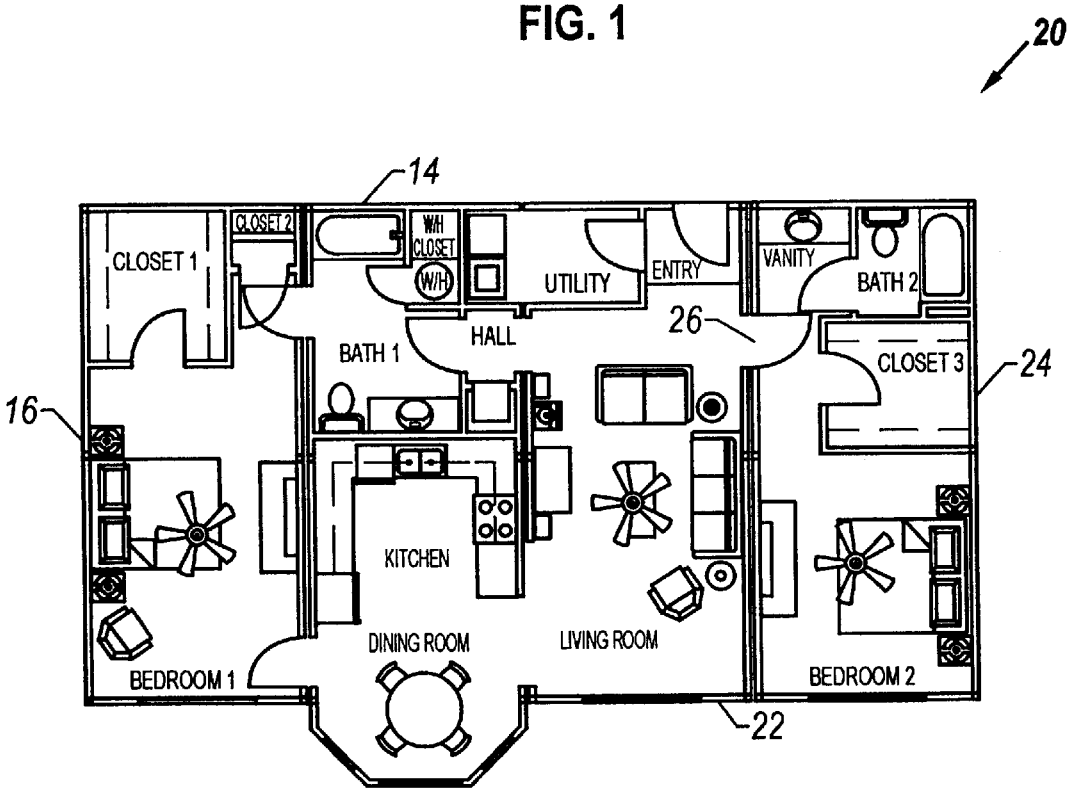
FIG. 2 is a floor plan view of a two bedroom unit constructed from 4 modules.

A preferred two bedroom apartment is shown in floor plan view in FIG. 2. The two bedroom apartment 20, utilizes the same second module 14 and third module 16 as the one bedroom apartment 10. The apartment 20 also utilizes a fourth module 22 that is identical to the first module 12 except for a doorway 26 in the side wall, that provides a passageway into the second bedroom module 24. An aspect of the present disclosure is the use of a few modules in combination to create functional living space. For example, the floor plans shown in FIGS. 1 and 2 are designed to promote a smooth traffic flow within the living spaces and are also designed to accommodate handicapped persons who are confined to wheelchairs. Because of this design, the modular buildings are particularly useful for geriatric communities. While the drawings show the preferred apartments including the proposed furniture, it is understood that the modules may be furnished differently, or the interior walls changed without departing from the spirit of the present disclosure.

Although the floor plans shown in FIGS. 1 and 2 could be constructed as stand alone, single family dwellings, in a preferred embodiment of the described building, the building comprises multiple apartments, preferably alternating one and two bedroom units joined side by side. Such a building would include a one bedroom apartment on one end thereof, abutting a two bedroom apartment, followed by another one bedroom apartment and then a two bedroom apartment, and continuing in like manner to the opposite end of the building. Other arrangements are, of course, possible, including but not limited to buildings consisting of only one or only two bedroom apartments, or with a combination of 1, 2 and 3 bedroom apartments, but the described arrangement is a preferred embodiment of the invention. Furthermore, a building comprising two 1 bedroom apartments alternating with two 2 bedroom apartments per floor is particularly preferred.

Figure 3A:
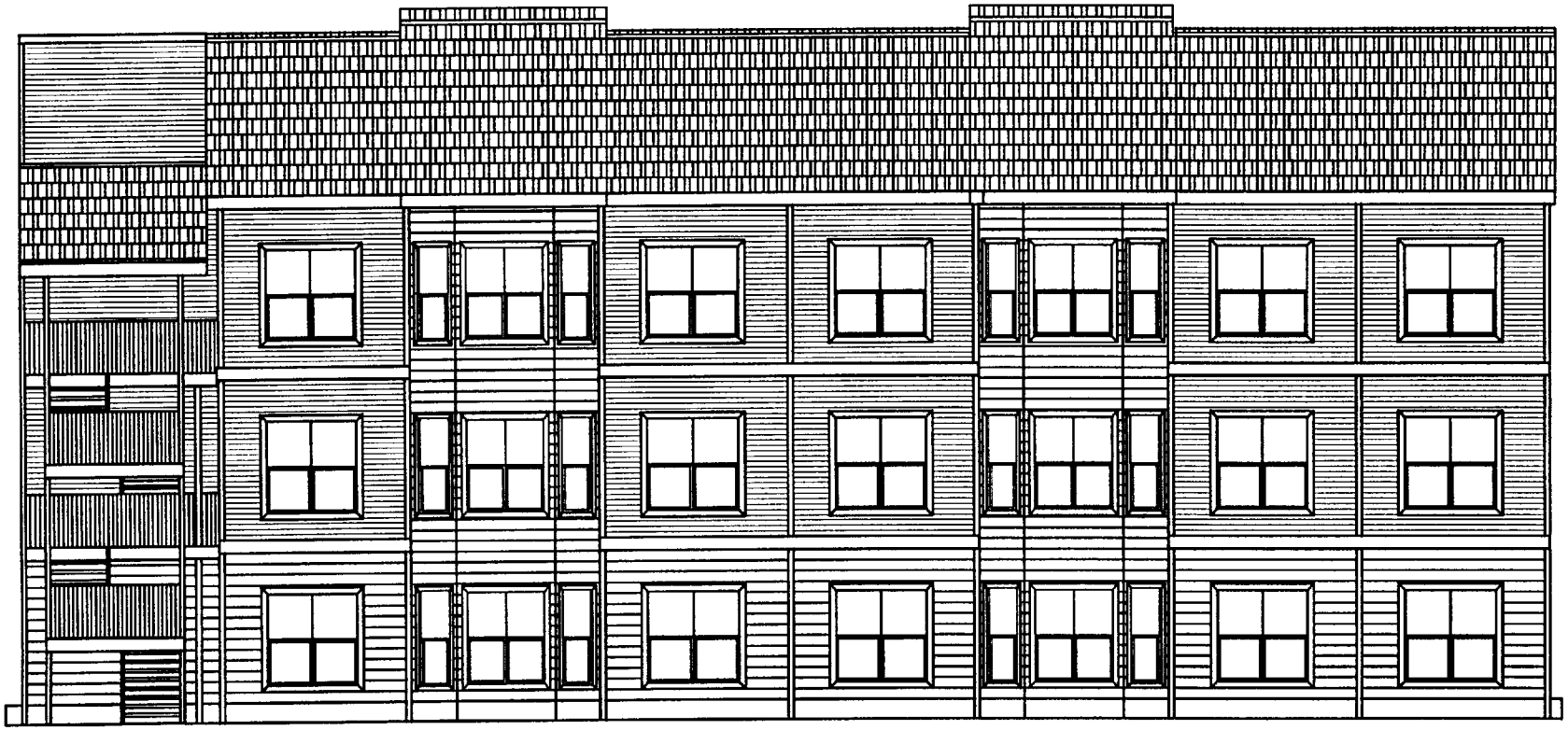
FIG. 3A is a front elevation view of a 12 apartment building segment.

It is also a preferred embodiment that the multifamily residential buildings constructed of 2 identical building segments disposed face to face, wherein each is a 3 story building with 4 apartments per floor, as alternating one and two bedroom units. In the preferred building, as shown in FIG. 3A, the modules are placed so that each module is always stacked on a like module in vertical alignment from floor to floor. In other words, each ground floor module has only like modules above it up to and including the top floor. By like modules, is meant a module 12, for example, which in a 3 story building would only have other modules 12 above it. This arrangement offers certain advantages, as the bay windows of the dining room modules are in alignment and the utility chases as shown in module 14 are in vertical alignment. When discussing like modules, it is meant that the modules provide the like portions of an apartment or living area, and does not necessarily mean the modules are identical in every way. For example, certain modifications are made to ground floor modules such that the construction of upper modules may differ from that of lower modules. It is also a preferred embodiment that two building segments are constructed in opposing fashion such that the entries for each apartment face the opposing building segment and that the two building segments share common breezeways and stairways. The preferred arrangement is not a "mirror image" arrangement, but rather identical building segments that are disposed to face each other.

Figure 4:
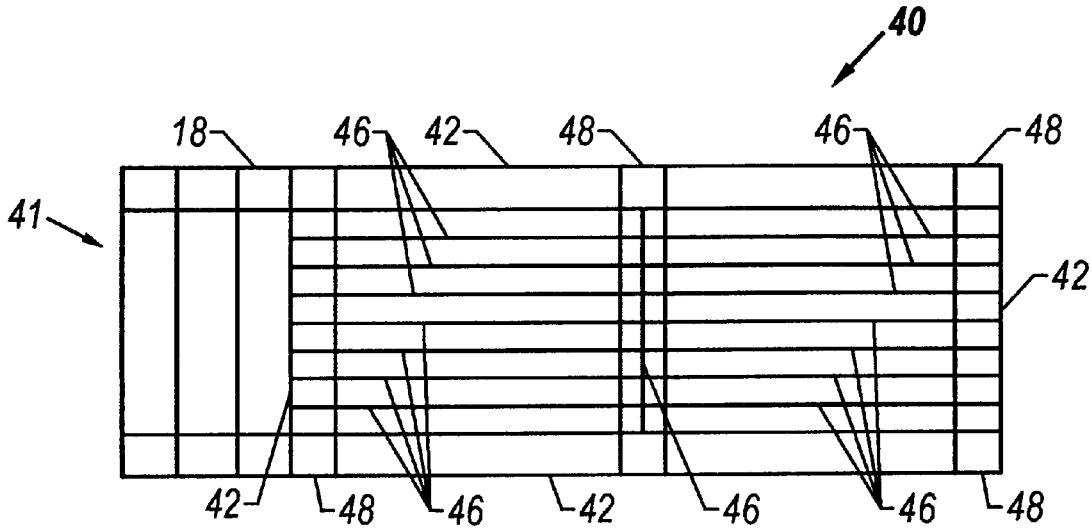
FIG. 4 is a schematic view of a floor frame for a module.
Figure 5:
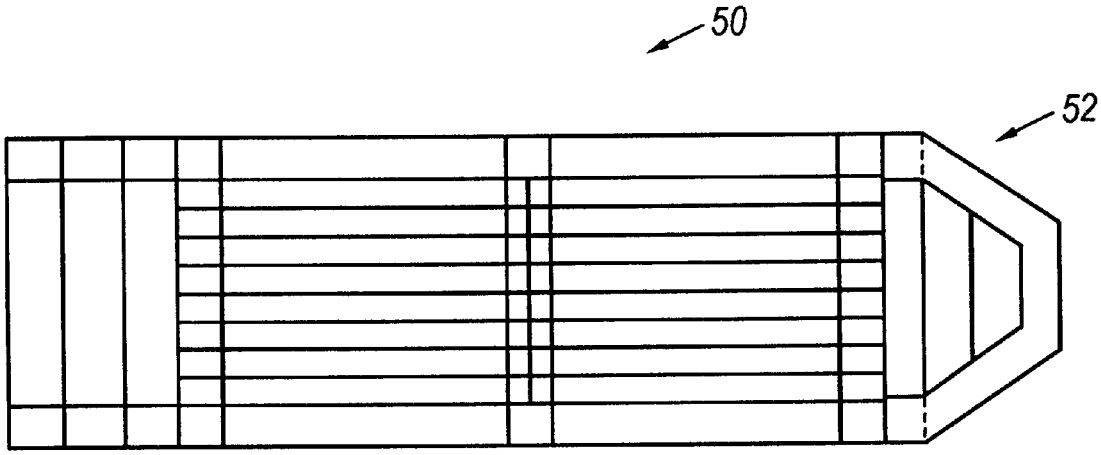
FIG. 5 is a schematic view of a floor frame for a module with a bay window.

It is a further aspect of the present invention that each module includes a steel frame that forms the perimeter of the floor and supports the floor and the ceiling. A steel frame for a module is shown in FIG. 4. The floor frame 40, includes structural steel beams 42 such as C-channels of about 8 inches in height that form the perimeter of the floor and a cross beam 44 across the mid line of the module. To support the floor, light gauge metal floor joists 46 are connected to the channels 42, 44 preferably with clip angles. It is also understood that other materials, such as dimension lumber, a composite, a combination of wood and steel, or a plastic, fiberglass or injection molded material could be used for the floor beams and joists, but that the steel described here is the preferred embodiment. Also shown in FIG. 4 are six vertical support columns or stanchions disposed one at each corner, and one at or near the center of each side wall. Although there are six columns in the preferred embodiment, other structural plans may be used, utilizing either a greater or fewer number of support columns as needed for a particular type of construction. For example, certain modules may utilize only four columns at the module corners, or as many as 8 or 12 columns per module as needed. These columns provide support for the walls of the module in transferring horizontal loads, as well as support for the modules that may be stacked above a particular module in use. Also shown in FIG. 4 is an extension with cantilever beams and joists to provide an open hallway structure in the finished building. In the preferred embodiment of an apartment building, the open hallway structure forms the floor of a common breezeway when a building includes two segments of apartments disposed in opposition. In that instance, the extension shown would be welded to a similar extension from the facing building segment to provide a form for a plywood subfloor with a lightweight concrete filler that would be shared by the two building segments. FIG. 5 is a diagram of a floor frame 50 for a module that includes a bay window extension 52 to provide a bay window as in module 14 shown in FIG. 1 and 2. In the frame formation for the described modular buildings, all connections are designed giving particular attention to mass production or factory environment restrictions.

Figure 6:
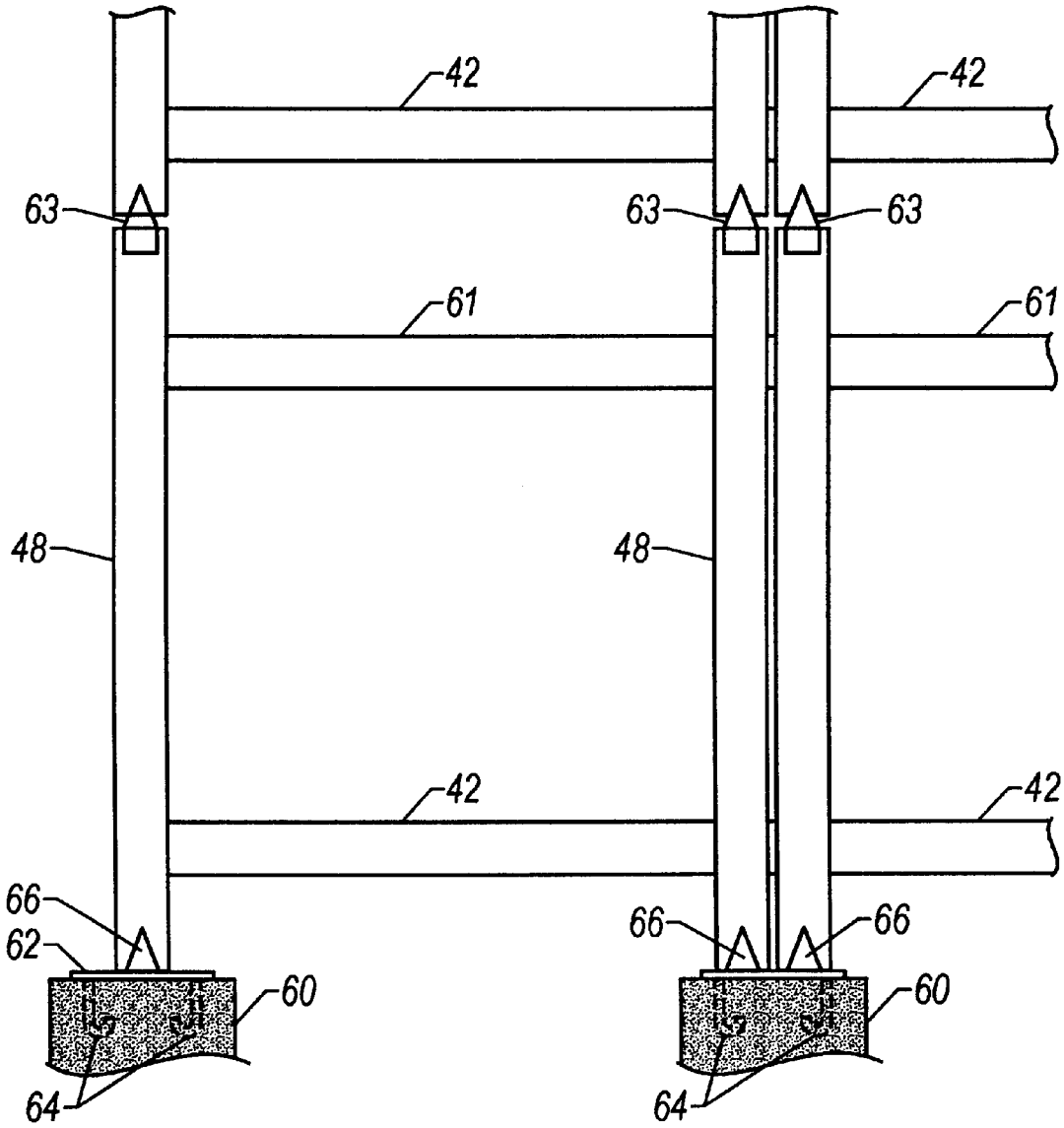
FIG. 6 is a schematic view of a set of concrete piers with structural members set thereon.

The described buildings may be placed on any suitable type of foundation including, but not limited to concrete piers, monolithic slabs or post-tensioned slabs, driven piles, or concrete footings, for example. In the described preferred embodiment, the foundation of the building includes concrete piers configured to align with and support each structural steel column of each ground floor module. The bottom or ground floor modules may be attached to the foundation by welding, bolting or any other known method. As shown in FIG. 6, the piers 60 are spaced so that the vertical support members 48 of the ground floor modules are each placed above a pier when the module is set at the building site. The piers are capped with a steel plate, preferably about ¾" in thickness that is anchored to the pier with 12" steel studs 64. Welded to the cap plates are steel projections 66 that extend into and align the support members 48 of the ground floor modules. In a preferred embodiment the projections are cone-shaped. As shown in FIG. 6, steel plate 62 is preferably about 10"×10" and holds a single projection 66. This pier would be used at an outside edge of the building on a wall that does not adjoin another unit. At a junction of two modules as shown in FIG. 6, steel plate 68 is preferably about 10"×15" and holds 2 projections 66 spaced to accommodate support columns on adjacent modules.

Figure 7:
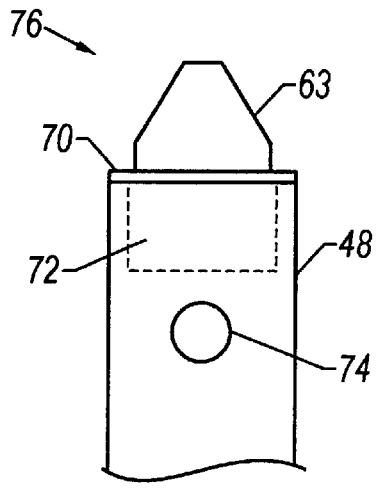
FIG. 7 is a schematic view of a projection piece used to connect vertical members in vertically stacked modules.

Also shown in FIG. 6 are the perimeter support beams 61 for the ceiling of the lower modules. As can be seen from the drawing, the upper end of the support columns 48 are substantially hollow, as would be the case with hollow steel tubes, and a cast metal projection piece 63 is welded or attached with epoxy into the upper end of each vertical support 48. These projections are preferably the same shape as the projections 66 that are anchored to the pier caps along with the monolithic bottom extension and aid in alignment and support of the modules when placed in the building during erection and site construction. The projection also serves to give mechanical horizontal restraint and to resist movement in the lateral direction. The top of a vertical support 48 is shown in FIG. 7. A monolithic piece that includes the cone shaped projection 63 and a substantially square projection member 72 separated by a ½" thick plate 70 is shown welded in the support member 48. The flat plate 70 serves as a lip or flange to prevent the piece from falling into the hollow member 48 while the projection 72 extends into the support member 48 and aligns the cone shaped projection 63 when the piece is in place. Also shown in FIG. 7 is a hole 74 in the structural member 48 that accepts a pin to lock in the lifting devices during lifting of the modules by a crane during erection.

Figure 8:
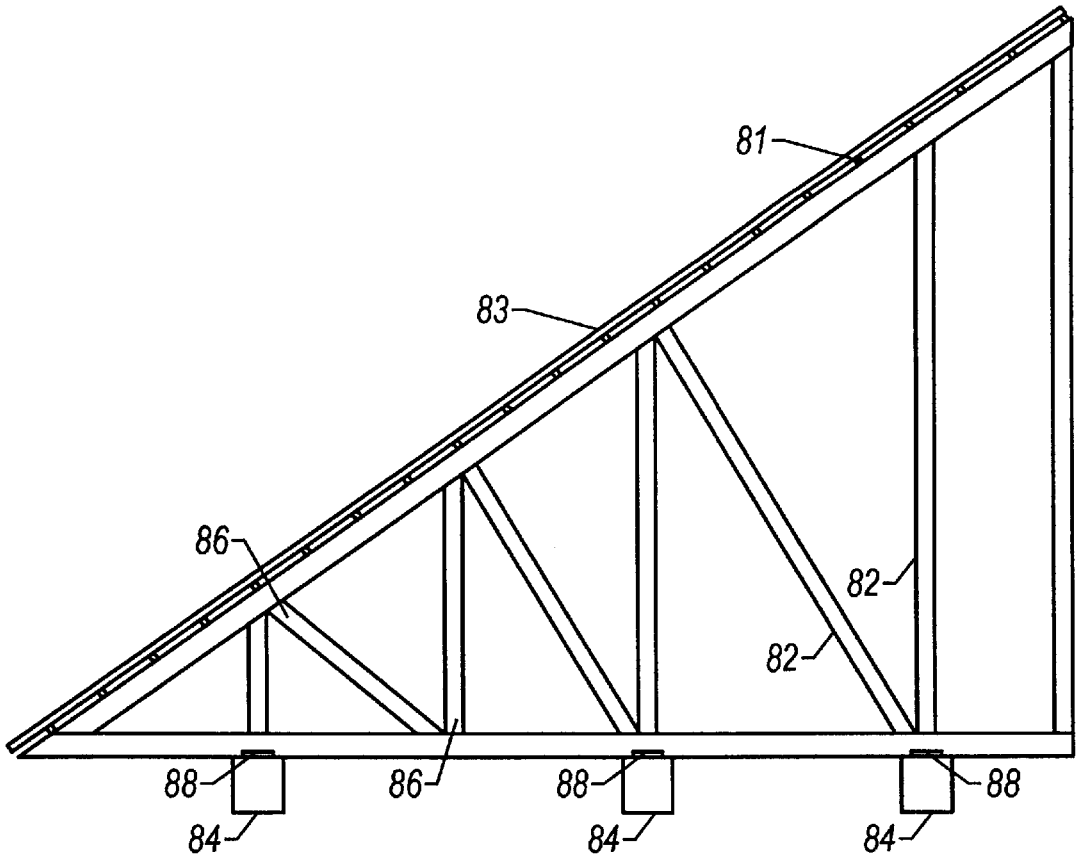
FIG. 8 is a side view of a roof module prior to installation of sheathing.
Figure 9:
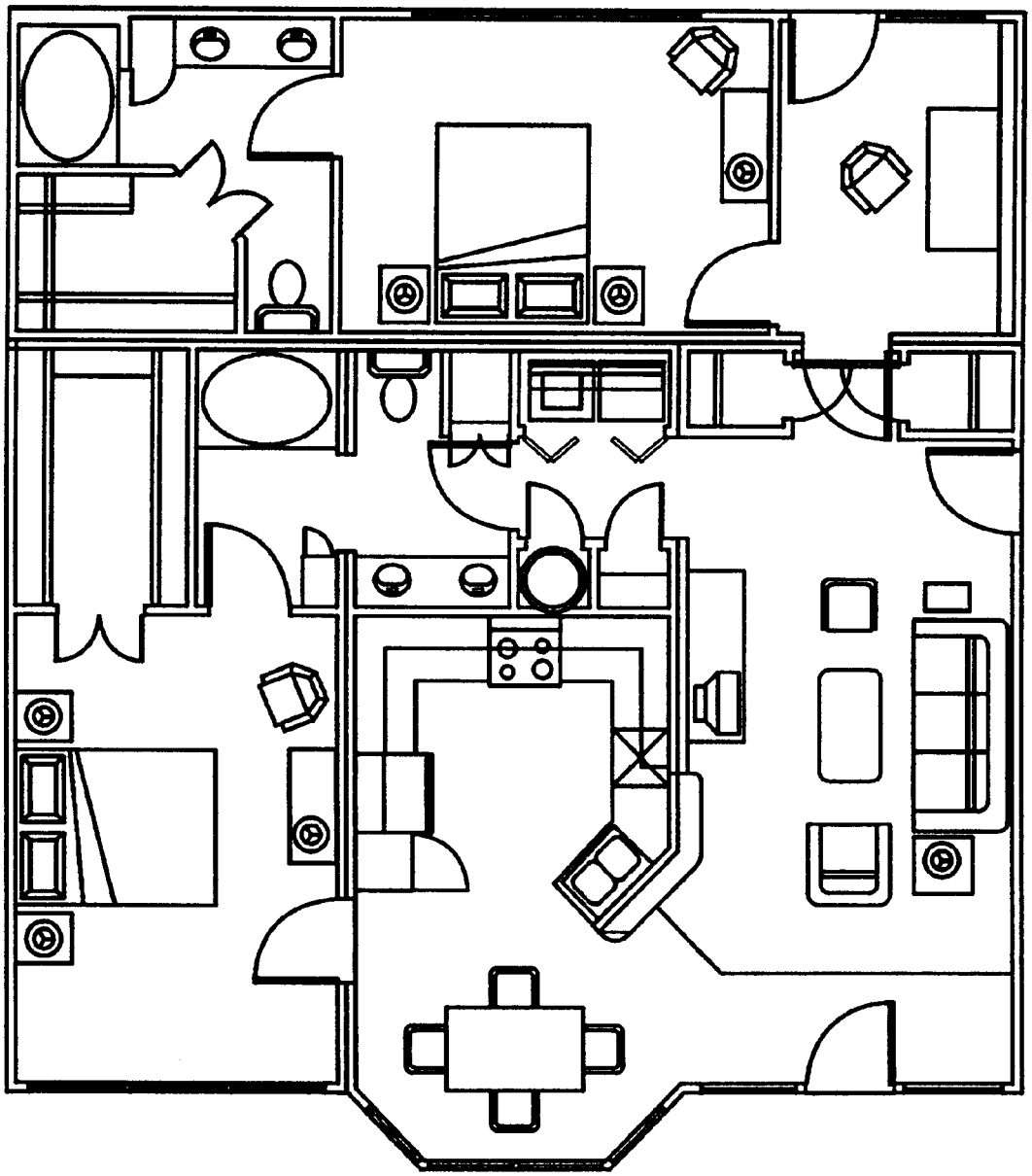
FIGS. 9–15 are a floor plan views of single family residences constructed of modules as described herein.
Figure 10:
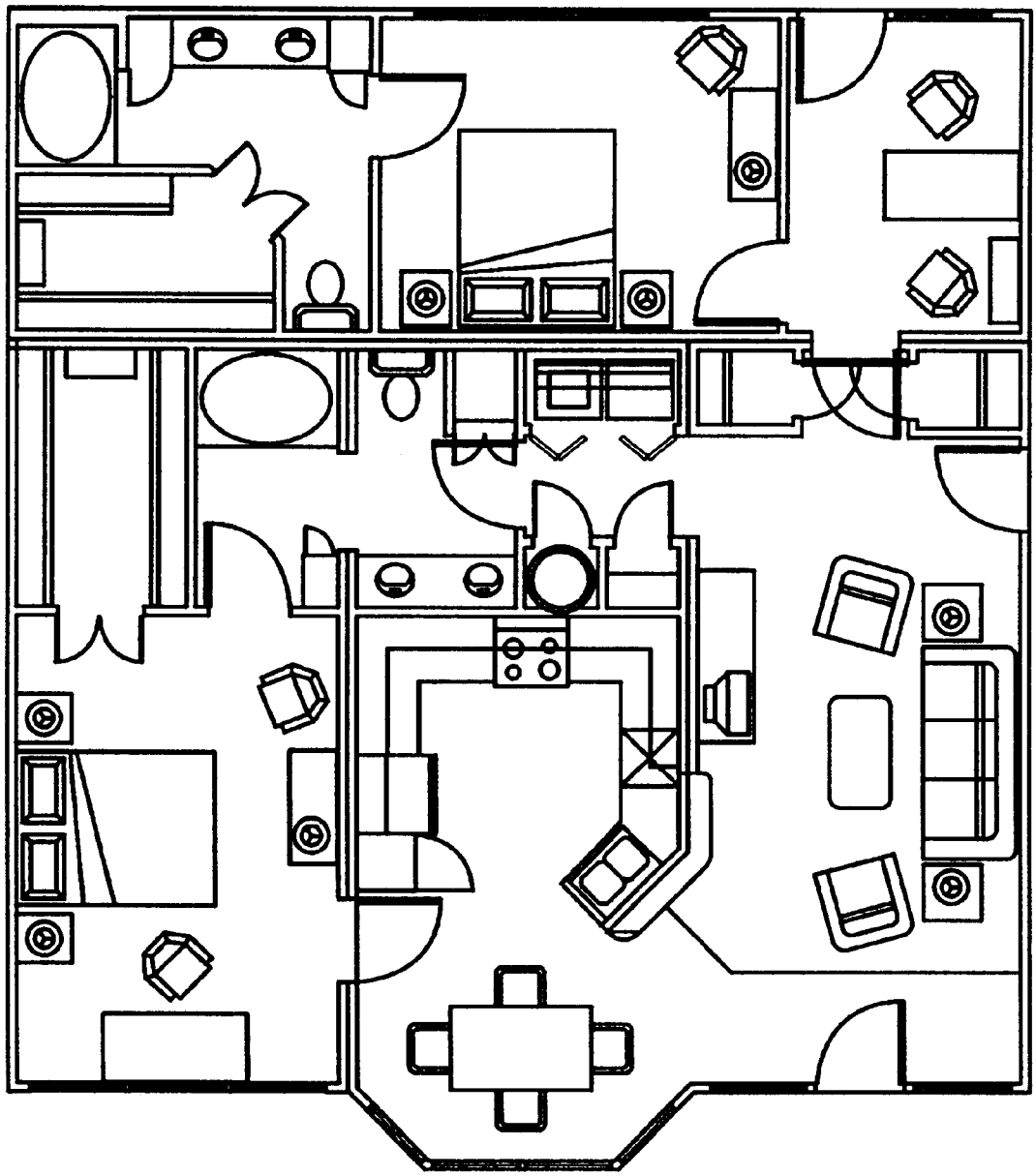
Figure 11:
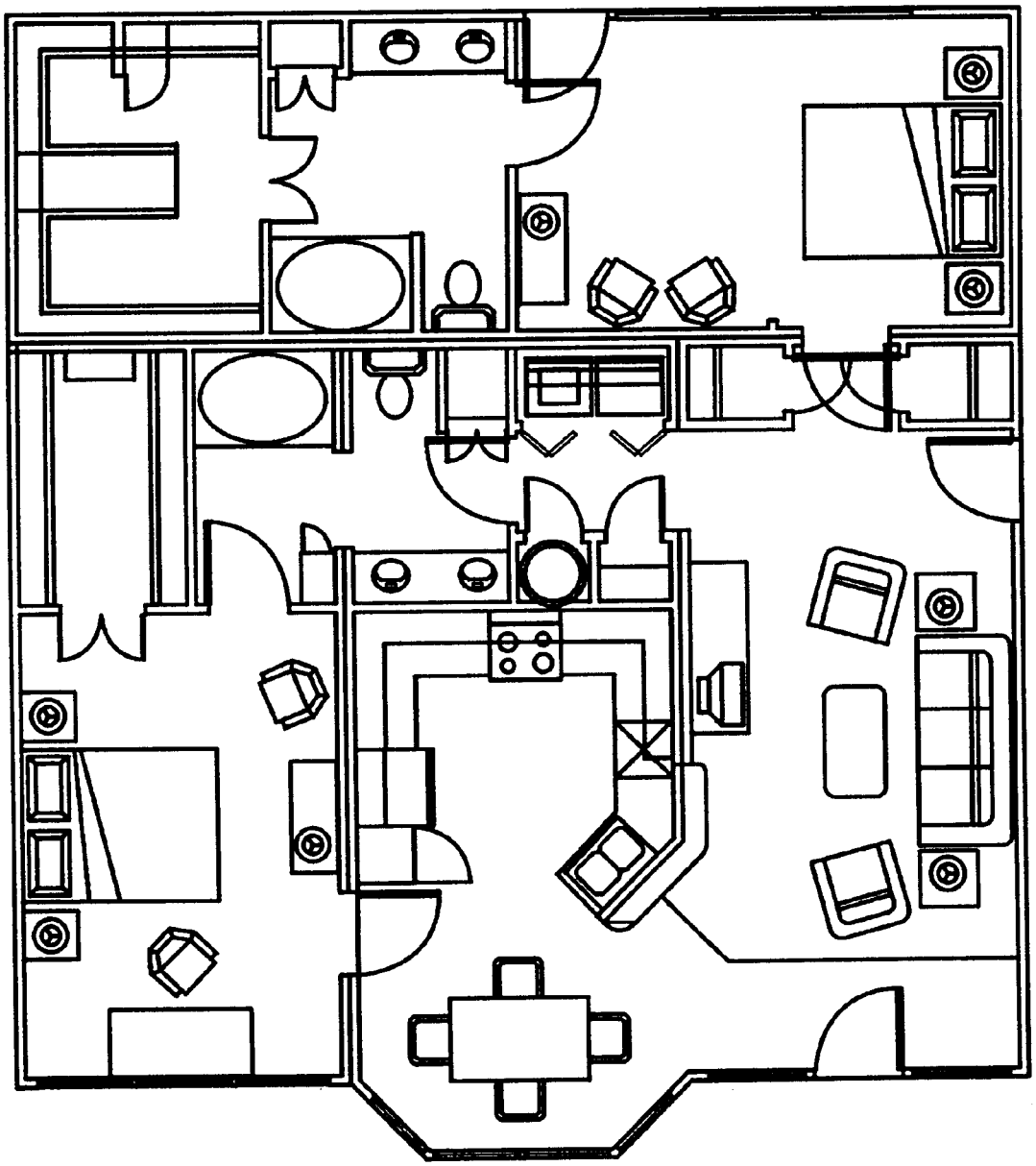
Figure 12:
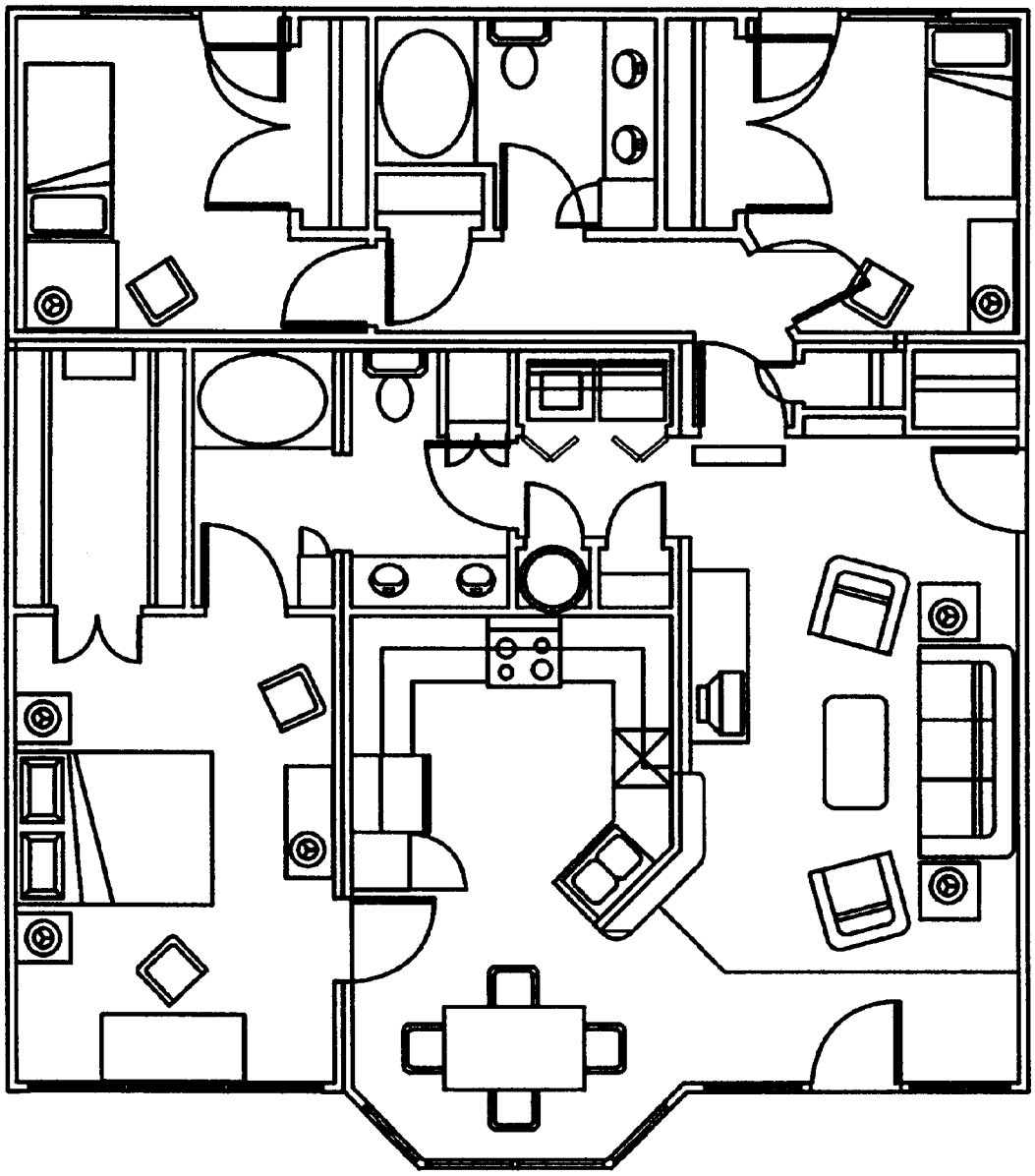
Figure 13:
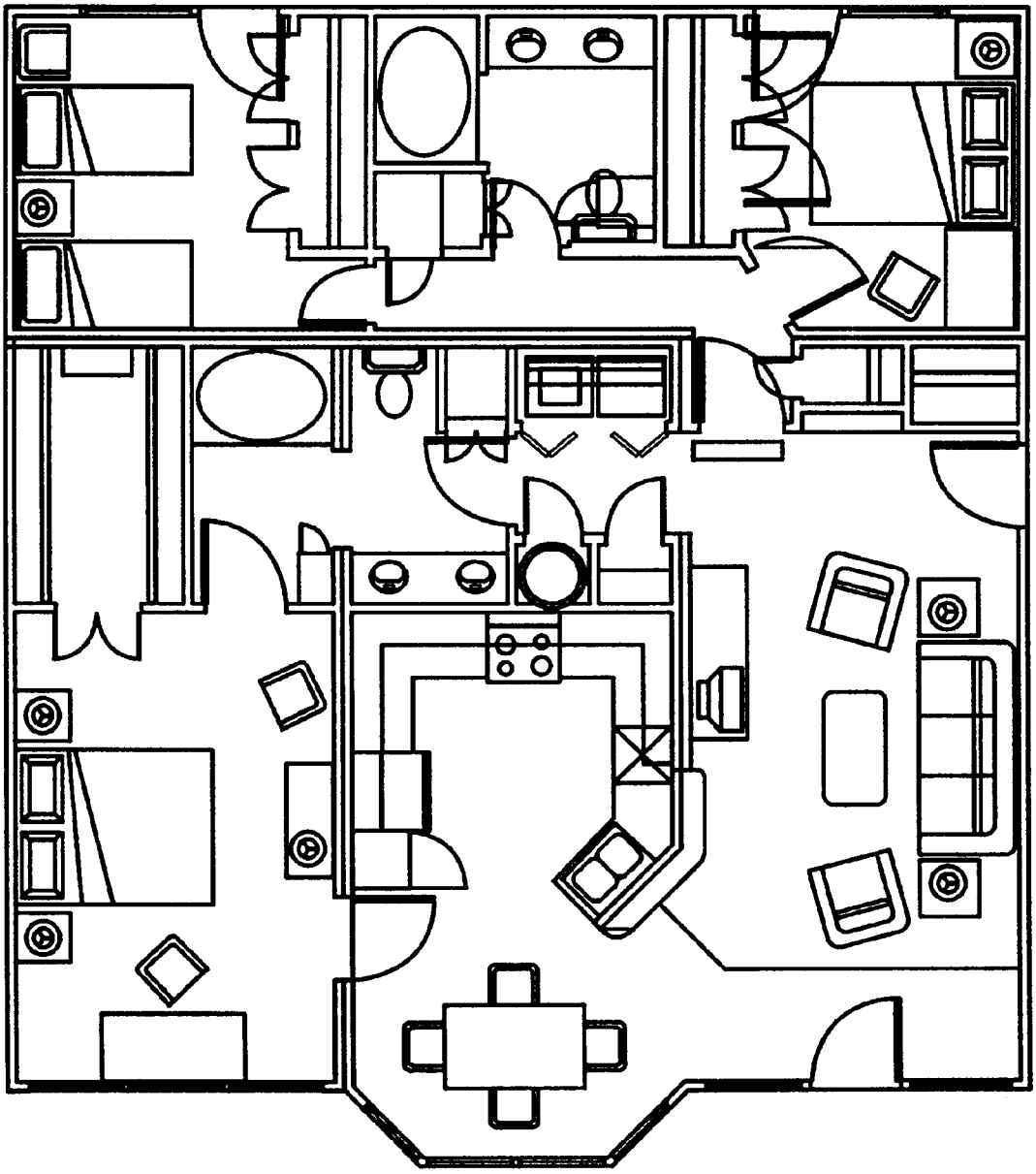
Figure 14:
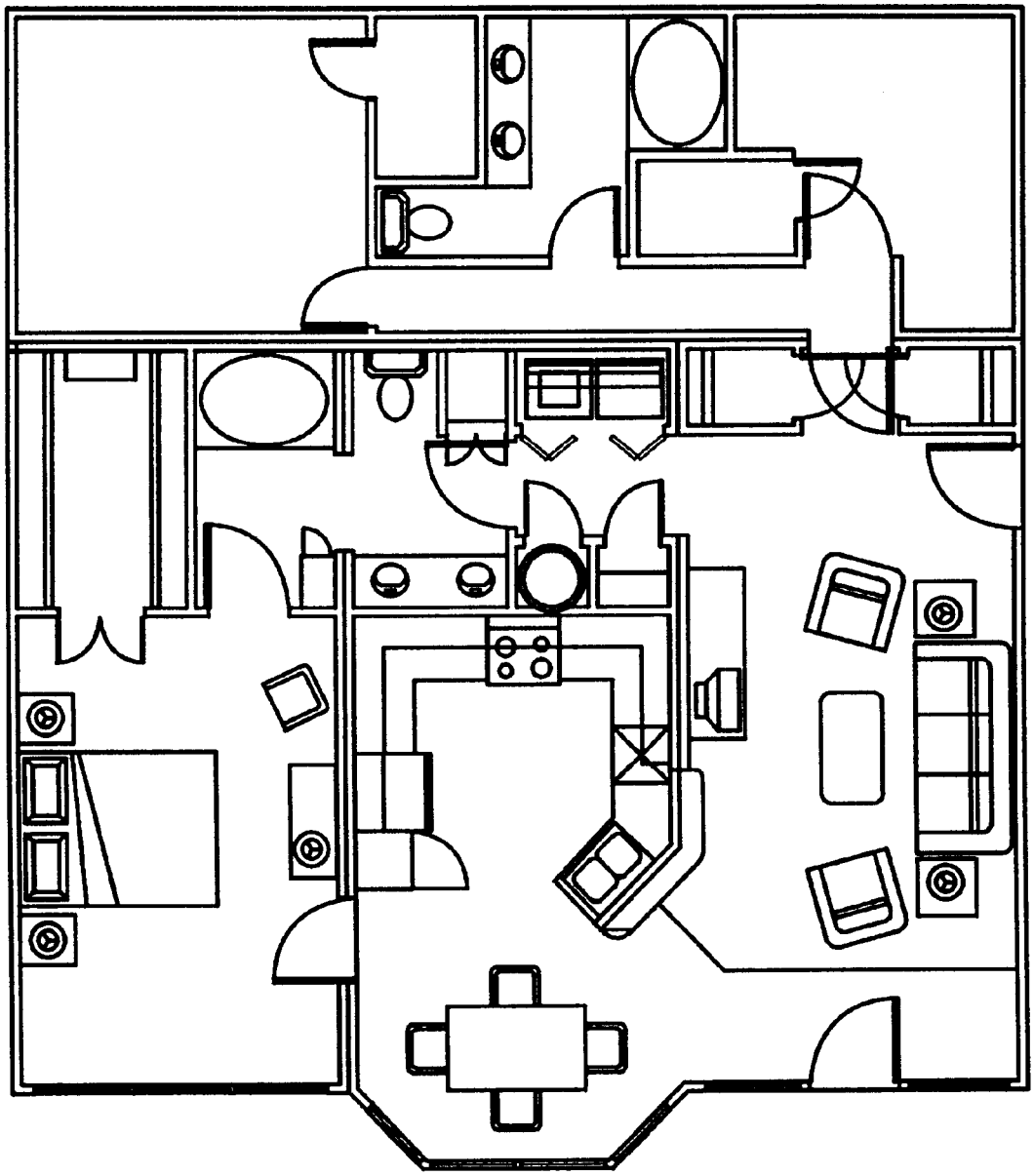
Figure 15:
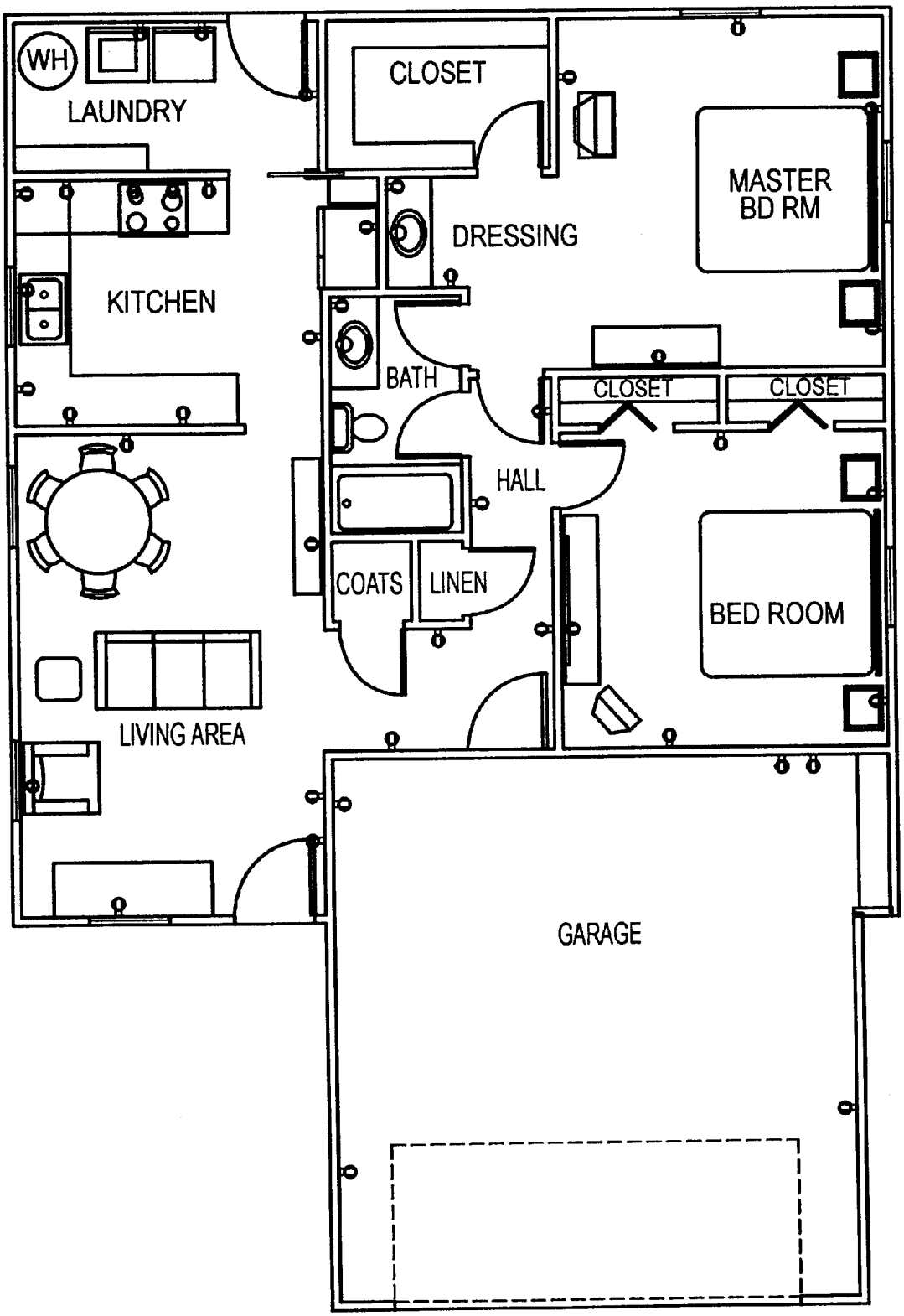

In the buildings described herein, the roof may be built in the manufacturing facility and transported to the construction site or they may be built on site and lifted into place on the erected buildings. In a preferred embodiment, the roof is formed from independent modular units such that each roof module is designed to provide a roof over a single module. As shown in FIG. 8 the main supporting elements of the preferred unit is constructed from light gauge steel (LGS) members 82 to form trusses. The light gauge steel may be CEE or any other appropriate shape. The trusses are spaced apart, preferably 4 feet center to center (c/c) and are supported on spaced steel tubular beams 84. The tubular beams 84 are spaced to align with the structural support columns of the building and are welded or bonded to the support columns in the same manner as stacked modules are joined. The trusses are preferably constructed with #10/#12 connection screws at the joints 86 and the connections between the trusses and the beams is made by welding and/or by appropriate screws using light gauge steel clip angles 88. The top members of the trusses give support to the purlins 81, which are preferably light gauge hat sections or suitable rolled sections spaced at 24" c/c connected by #10 screws. The purlins are then covered by decking material 83 such as ⅝" oriented strand board (OSB) or other type of plywood. The decking is then covered with shingles.

The system stability is achieved by connecting the vertical and bottom members of the trusses by light gauge steel 18 to 20 gauge hat channel or similar suitable rolled sections bracing members one of which spans from the top of one vertical member at the first edge of the roof module to the bottom member on the opposite edge of the roof module and a second spanning member that connects in the opposite orientation so that each vertical support on the edge of the module is connected to the bottom member on the opposite edge of the module. The sides of the framed assembly may then be clad as appropriate with ½" to ¾" gypsum board or other suitable sheathing material. The module is finished by adding dimensional lumber fascia to the perimeter. The erection of the roof modules is preferably done at ground level on preset jigs mounted on a trailer or platform that can be moved to the building erection site.

Figure 3B:
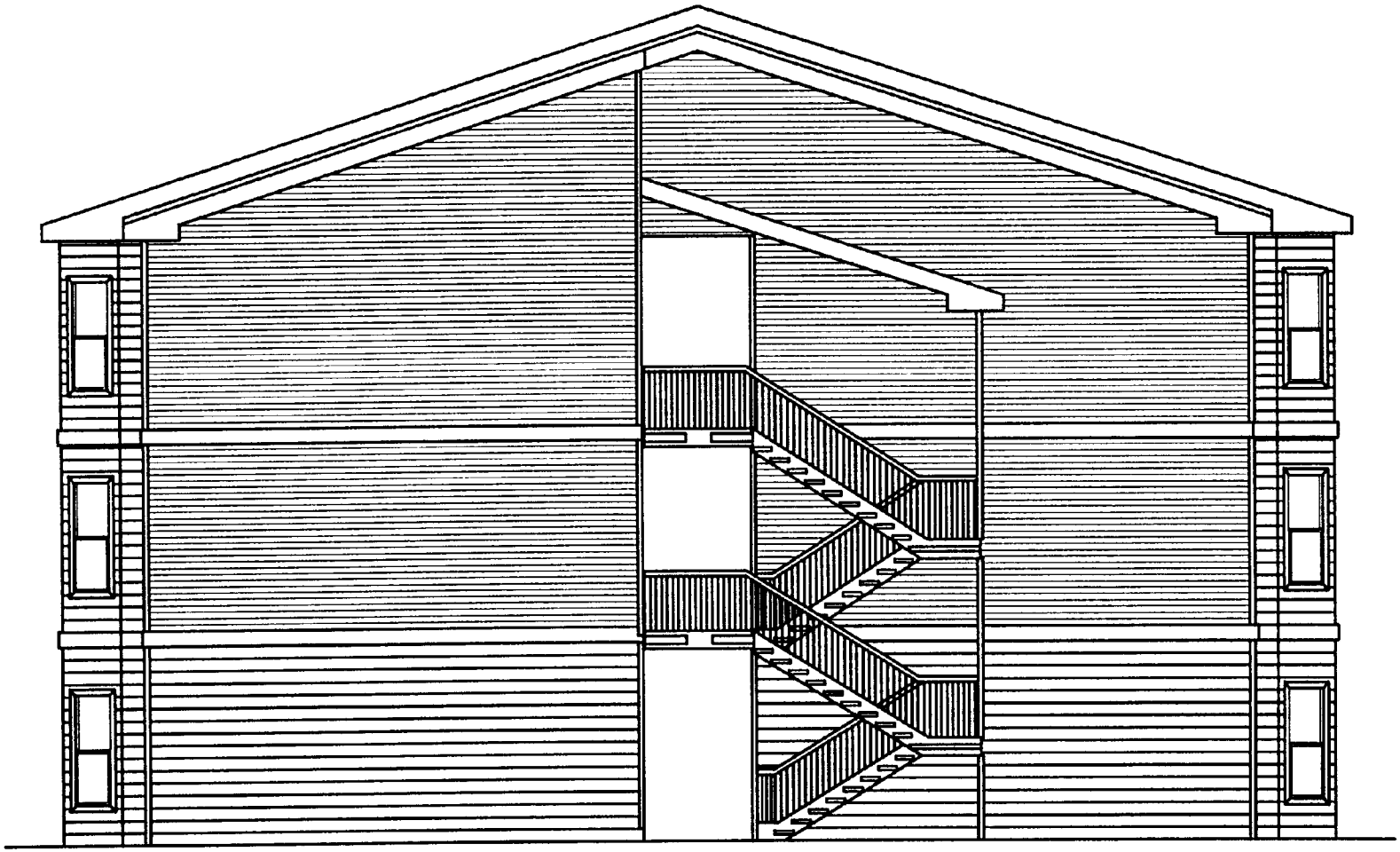
FIG. 3B is a side elevation view of the building segment shown in FIG. 3A in which the opposing segment can also be seen.

For installation, the roof modules are carried to the building location on the trailer or other platform and lifted by crane slings attached to the base structural steel beams without putting any load on the LGS truss members and placed directly on the top floor module vertical supports. The junction of the roof unit beams and the top floor module columns are then welded directly or by using ¼" connection plates. Finally, adjoining roof module members are also joined by LGS plates at 2 to 3 locations depending on the height of the members. The roof over the entire building is completed by lifting such independent single roof units and placing them directly on support points provided by the top floor modules below. In the preferred 2 segment building described herein, the mono-pitch roof units meet at the peak as shown in FIG. 3B and cover the common breezeway between the two segments.

In an alternative embodiment, the collapsible roof modules may be used. These modules are preferably made in situations where it is not feasible to construct the rigid roof described above due to space limitations and/or height restrictions during transportation. The overall construction/erection principles are similar to the rigid roof modules except that connections between LGS truss members in the vertical planes and bottom chord members are formed using hinges or pins allowing full rotation of the joints. This enables the truss assembly including final decking and shingles to rest flat on the bottom members of the trusses that are welded or otherwise fastened to the main structural steel beams. These units are typically fabricated off site without the sheathing attached and are placed either on the top of the floor modules or separately on trailers for transport to the construction site. At the building location, the trusses along with the roof coverings are rotated back to the final position. Hinges are locked in making them rigid joints. Side sheet rock or sheathing is then installed and the unit is lifted by crane for final installation.

The modules as shown and described herein may be made of any conventional construction materials including gypsum drywall and sheathing and wood studs. It is a preferred embodiment, however, that the modules are framed with structural steel and light gauge steel framing members to provide further strength and uniformity of construction.

Certain aspects of the present invention are also methods of constructing modular buildings. These methods include producing a plurality of modules in a manufacturing facility, wherein each module is produced by constructing a substantially rectangular steel frame that defines and supports the perimeter of the floor of each module and wherein the steel frame is attached to vertical structural members, in certain embodiments, one at each corner of a module and one at or near the center of each side wall of a module. In the disclosed methods, each module is configured to provide a part of the floor plan of a finished unit; each module is substantially rectangular in shape with a front wall, a rear wall and two side walls, and each module is configured so that the side walls of each module extend from the front to the rear of a building constructed with the modules during use; the modules are designed to be disposed in parallel alignment with their side walls abutting to form a common wall between modules and with openings in the side walls of the modules to provide passageways between modules within a unit; and the modules may be configured to produce two or more floor plans for units within a building during use.

The methods further include constructing each module to a semi-finished state in the manufacturing facility prior to transporting the modules to the construction site. The semi-finished state would include a floor, exterior and interior walls, windows and a ceiling. The semi-finished state may also include sheathing and insulating the exterior walls, applying drywall and installing some cabinets, trim, windows, doors, plumbing and certain plumbing fixtures, electrical wiring, outlets, fixtures and heating equipment and ductwork. The interior may also be painted prior to delivery to the construction site, or it may be painted after erection and repair of any superficial defects occurring during transportation. The modules may be completed to any stage in the interior, but it is preferred to install the electrical fixtures and flooring at the construction site to prevent damage to hanging fixtures during transport and to prevent damage to the flooring during final construction. After the modules are completed in the manufacturing facility they are wrapped with shrink wrap material for protection from the elements, loaded individually on flat bed trailers and transported to the building site. In preferred embodiments, the modules are no more than 11 or 11½ to 14 feet in width to facilitate moving the modules on public streets or highways.

The construction process begins in the manufacturing facility, in which a structural steel is placed in a jig on a skid and welded into the floor frame of a particular module type. The skid is moved through the manufacturing facility as the module components are added. Light gauge metal floor joists are added to the floor frame and a subfloor is added to the floor joists. The subfloor is preferably a plywood or oriented strand board (OSB) product that may be covered with floor covering such as carpet or vinyl flooring, or it may be covered with a light weight concrete floor. It is preferred, however, that carpet or vinyl flooring products are installed after the module has been placed and most of the construction is complete. The floor frame is constructed such that preferably square hollow steel tubes in the floor frame accept structural vertical support columns that extend below the frame for attachment to either the foundation, if the module is erected on the ground floor, or to a structural column of the module below in the building. The vertical columns are bonded with epoxy and/or welded to the floor frame assembly. A structural frame is also added to the vertical columns at ceiling height, again with the column extending above the frame to bond to the room module or roof module above in use. The vertical columns are braced with steel cables, with the comer columns braced by diagonally crossed cables from column to column on the ends of the modules and interior columns braced from near ceiling height to the floor structure by steel cables.

The wall framing is assembled from light gauge steel studs preferably placed in color coded jigs, so that semi-skilled laborers can produce the correctly framed walls. The framed wall sections are placed on a table and sheetrock is added to the walls and screwed to the studs with a carriage of automated screw guns. The walls are then attached to the structural frame and the modules are constructed to a semi-finished state. The modules are then wrapped in shrink wrap and transported to a shipping area, where they are loaded onto trailers for transportation to the construction site.

In the preferred methods, the building site is prepared by placing concrete foundation piers in the ground for each ground floor module of a building, wherein each foundation pier is configured to align with and provide a foundation for one or two vertical support members and wherein each pier is topped with one or two projections configured to extend into the bottom of a vertical support member when a module is placed on the piers during construction. When the modules arrive at the building site a lifting gear is attached to four or more of the vertical structural members and the module is lifted from the trailer by a crane and placed on the piers. This process is repeated until the first floor is completed. As the modules are welded in place, a crew of workers connects all necessary electrical, plumbing and ducting connections that run horizontally from module to module across the ceiling. After the first floor is complete, subsequent modules are lifted onto the first floor modules to construct the second floor. Again a crew makes the necessary horizontal connections, joining the modules with ½" steel plates with double openings and may also run the vertical connections into the utility chase of the first floor modules. After all the modules are set, roof modules are added to the top floor and the abutting modules are joined with welded joints thus providing continuity to the final structure of the building to ensure stability. The external connections are then made to the buildings and the buildings are finished by conventional means.

While the structures and methods of this invention have been described in terms of preferred embodiments, it will be apparent to those of skill in the art that variations may be applied to the structures and/or methods and in the steps or in the sequence of steps of the methods described herein without departing from the concept, spirit and scope of the invention. All such variations apparent to those skilled in the art are deemed to be within the spirit, scope and concept of the invention as defined by the appended claims.

What is claimed is:

1. A method of constructing residential buildings comprising:

providing a manufacturing facility configured to produce a plurality of types of building modules wherein each module is constructed on a skid, and wherein construction of said module comprises constructing a floor frame, including floor joists and a subfloor, and a ceiling frame, said floor frame and ceiling frame being bonded to structural columns to provide a structural frame for said module;

constructing interior and exterior walls of said module in jigs, attaching sheathing to said interior and exterior walls; and attaching said walls to said structural frame; and constructing said module to a semi-finished state in said manufacturing facility;

transporting said semi-finished modules to a construction site on trailers;

preparing a foundation for said residential buildings said foundation providing structural support for each of said structural columns;

lifting said modules from said trailers with a crane;

attaching said modules to said foundation; wherein said structural columns comprise hollow steel tubes, and wherein said foundation comprises cone shaped projections configured to insert into said hollow steel tubes when said modules are set on said foundation, and wherein attaching said module to said foundation comprises welding said projections into said tubes; and connecting utilities to said modules and constructing modules to a finished state;

wherein a plurality of modules are arranged to provide a residence;

and further wherein at least a portion of said types of modules may be configured with alternate adjoining modules to produce a plurality of floor plans.

2. The method of claim 1, wherein said module comprises six structural columns, one at each corner of said module and one near the center of each side wall of said module.

3. The method of claim 1, wherein said floor frame, ceiling frame and said columns comprise structural steel.

4. The method of claim 1, wherein said interior and exterior walls comprise studs made of light gauge steel, fiberglass, a composite or an extruded material.

5. The method of claim 1, wherein said interior and exterior walls comprise studs made of light gauge steel.

6. The method of claim 1, wherein said semi-finished state includes exterior walls insulated and covered with sheathing and drywall, drywall on the ceiling, wiring for electrical fixtures, appliances and outlets, installed plumbing and plumbing fixtures, installed electrical plugs and switches, installed cabinets, installed trim, windows, doors, heating and air exchange unit.

7. The method of claim 1, wherein said residence is a single family residence.

8. The method of claim 1, wherein said residence is a multi-family residence.

9. The method of claim 1, wherein said residence comprises a multi-story building.

10. The method of claim 1, wherein said foundation comprises concrete piers, a slab, a concrete footing, or driven piles.

11. A method of constructing a modular building comprising:

(a) producing a plurality of modules in a manufacturing facility, wherein each module is produced by constructing a substantially rectangular steel frame that defines and supports the perimeter of the floor and ceiling of each module and wherein said steel frame is bonded to vertical support columns; and wherein (i) each module is configured to provide a part of the floor plan of a finished unit;

(ii) each module is substantially rectangular in shape with a front wall, a rear wall and two side walls, and each module is configured so that the side walls of each module extend from the front to the rear of a building constructed with the modules during use;

(iii) the modules are designed to be disposed in parallel alignment with their side walls abutting to form a common wall between modules and with openings in the side walls of the modules to provide passageways between modules within a unit; and (iv) the modules may be configured to produce two or more floor plans for units within a building during use;

(b) constructing each module to a semi-finished state in the manufacturing facility, comprising adding to each module a floor, exterior and interior walls and a ceiling;

(c) preparing a building site by placing concrete foundation piers in the ground for each ground floor module of a building wherein each foundation pier is configured to align with and provide a foundation for one or two vertical support members and wherein each pier is topped with one or two projections configured to extend into the bottom of a vertical support member when a module is placed on said piers during use; wherein said vertical support members comprise hollow steel tubes, and wherein said foundation comprises cone shaped projections configured to insert into said hollow steel tubes when said modules are set on said foundation, and wherein attaching said module to said foundation comprises welding said projections into said tubes;

(d) transporting individual modules to said building site and placing said modules on said concrete piers; and (e) attaching abutting modules with welded joints to construct one or more complete units in said building.

12. The method of claim 11, wherein said modules are no more than 14 feet in width.

13. The method of claim 11, wherein said modules are no more than 12 feet in width.

14. The method of claim 11, wherein each of said modules is transported to the building site on a trailer.

15. The method of claim 11, wherein placing the modules comprises attaching a lifting gear to four or more of said vertical support members and lifting said modules into place with a crane.

16. The method of claim 11, wherein said semi-finished state includes exterior walls insulated and covered with sheathing and drywall, drywall on the ceiling, wiring for electrical fixtures, appliances and outlets, installed plumbing and plumbing fixtures, installed electrical plugs and switches, installed trim, windows, doors, and heating and air exchange unit.

17. The method of claim 11, wherein said plurality of modules comprises:

a first module containing an entry, living room, and laundry room;

a second module containing a kitchen, dining area, and bathroom;

a third module containing a bedroom;

a fourth module containing a bedroom and bathroom; and a fifth module containing an entry, living room and laundry room;

wherein said first, second and third modules are configured such that:

each module comprises a front wall, a rear wall and two side walls;

the second module may be placed with one sidewall thereof abutted to a side wall of the first module and the opposite side wall of the second module abutted a side wall of the third module to provide a one bedroom apartment; and wherein the fifth module may replace the first module of the one bedroom apartment and a fourth module placed with a side wall abutted to the side wall of the fifth module to provide a two bedroom apartment.

18. The method of claim 17, wherein said second module includes a bay window in the rear wall thereof.

* * * * *